US006612714B1

(12) United States Patent
Morre et al.

(10) Patent No.: US 6,612,714 B1
(45) Date of Patent: Sep. 2, 2003

(54) BELT CLIP AND MOUNTING RECEPTABLE, AS FOR A FLASHLIGHT

(75) Inventors: Larry Everett Morre, Cottonwood, AZ (US); Peter John Ziegenfuss, Borough of Sellersville, PA (US)

(73) Assignee: Streamlight, Inc., Eagleville, PA (US)

( * ) Notice: Subject to any disclaimer, the term of this patent is extended or adjusted under 35 U.S.C. 154(b) by 31 days.

(21) Appl. No.: 10/046,600

(22) Filed: Oct. 23, 2001

Related U.S. Application Data

(60) Provisional application No. 60/244,366, filed on Oct. 30, 2000.

(51) Int. Cl.[7] ..... F21V 21/088; F21L 4/00

(52) U.S. Cl. ..... 362/191; 362/396

(58) Field of Search ..... 42/117, 146; 362/103, 362/108, 110, 190, 191, 396

(56) References Cited

U.S. PATENT DOCUMENTS

| | | | | | |
|---|---|---|---|---|---|
| 1,408,527 | A | * | 3/1922 | Lyhne | 362/190 |
| 1,901,253 | A | * | 3/1933 | Meginniss | 362/191 |
| 2,312,305 | A | * | 3/1943 | Berlinger | 362/191 |
| 2,601,613 | A | * | 6/1952 | Jahncke | 42/146 |
| 3,769,663 | A | * | 11/1973 | Perl | 362/191 |
| 4,400,763 | A | * | 8/1983 | Kribs et al. | 362/103 |
| 4,697,226 | A | * | 9/1987 | Verdin | 362/110 |
| 5,743,623 | A | | 4/1998 | Kerr | |
| 5,816,683 | A | * | 10/1998 | Christiansen | 362/110 |
| 5,848,834 | A | | 12/1998 | Kerr | |
| D427,347 | S | | 6/2000 | Sharrah et al. | |
| 6,270,231 | B1 | | 8/2001 | Kerr | |

OTHER PUBLICATIONS

Streamlight, Product Catalog, Jun. 2001, Front and Cover, pp. 1, 8–11,28–29, 32–33, Rear Cover.

* cited by examiner

*Primary Examiner*—Alan Cariaso
(74) *Attorney, Agent, or Firm*—Dann, Dorfman, Herrell & Skillman, P.C.

(57) ABSTRACT

A device is provided for mounting a light source to a gun and for alternatively attaching the light source to a second object. The device includes a clip and detachable mount. The clip connects to one of a variety of flashlights and is easily transported with the flashlight. The clip has a flexible clip arm that allows the flashlight to be clipped to a belt, a shirt pocket or other convenient location. The mount attaches to a gun, weapon, tool or other implement and cooperates with the clip arm on the clip so that the flashlight can be easily connected to the gun, weapon, tool or other implement when desired. The clip disconnects easily from the mount so that the flashlight and clip can readily be removed from the mount and clipped to another object.

32 Claims, 12 Drawing Sheets

BELT CLIP AND MOUNTING RECEPTABLE, AS FOR A FLASHLIGHT

This Application hereby claims the benefit of U.S. Provisional Application No. 60/244,366 filed Oct. 30, 2000.

FIELD OF THE INVENTION

This invention relates to a flashlight mount, in general, and, in particular, to a mounting body and a combination clip and mounting body as for mounting a flashlight.

BACKGROUND OF THE INVENTION

Police officers and other individuals who use guns in dark conditions often desire a portable light to illuminate their surroundings. A handheld light, such as a flashlight, can provide illumination, but it becomes unmanageable when the gun user must use both hands to control the gun. A light attached to a gun requires no use of the user's hands, but it adds unnecessary weight to the gun when the light is not in use. Therefore, it is desirable to have source of light that is easily detached when the light is no longer needed. In addition, it is desirable to have source of light that is easily attached to different objects once it is removed from the gun. In the latter instance, the individual may desire to clip the light to a belt, pocket or the like. As a result, there is a need for a device which can mount a light source onto a gun, permit easy detachment from the gun, and allow attachment of the light source to a different object.

SUMMARY OF THE INVENTION

With the foregoing in mind, the present invention is a device for mounting a light source, such as a flashlight, to an object, such as a gun, weapon, tool or the like and alternatively for attaching the flashlight to a different article, such as a pocket or belt. The invention includes a clip and a detachable mounting body. The clip is adapted for attachment to a flashlight and includes a resiliently flexible arm having a latch. The mounting body is adapted for attachment to an object and has a channel that cooperates with the latch on the clip arm. The channel releasably receives the clip arm and has an engaging surface that releasably engages the latch on the clip arm to connect the flashlight to the object.

According to another aspect of the invention, a mount body is adapted for receiving a flashlight and includes a first engaging feature and a second engaging feature. The first engaging feature is configured to engage a first object, such as a gun, weapon, tool or the like. The second engaging feature is adapted for engaging a flashlight, so that the mount body connects the flashlight to the object.

DETAILED DESCRIPTION OF THE PREFERRED EMBODIMENTS

Figure 1:
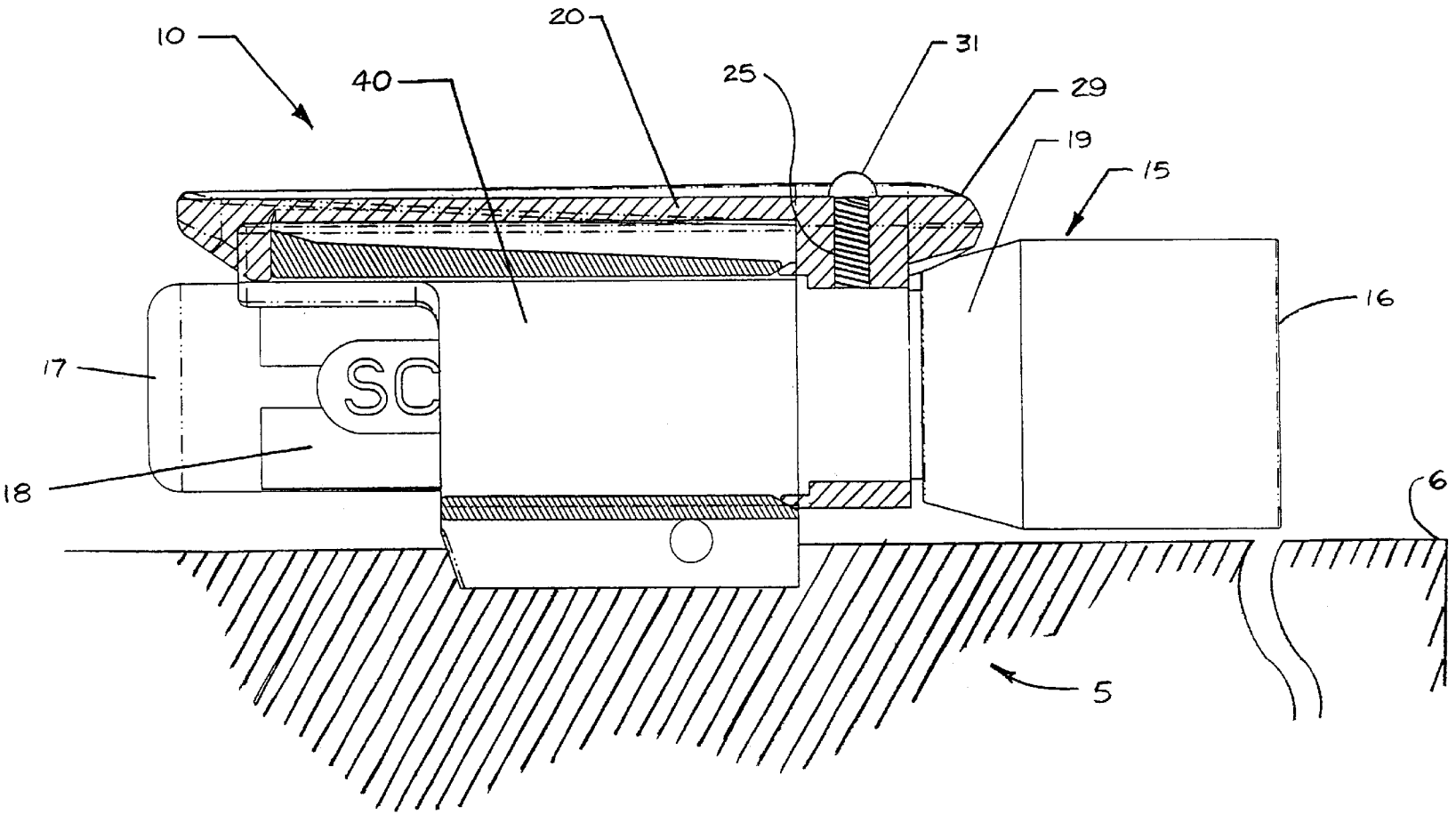
FIG. 1 is a side section elevation of a light mounting device in accordance with the invention mounted to a gun.

Referring now to the drawings, wherein like reference numerals refer to the same components across the several views, and in particular to FIG. 1, there is shown a flashlight mount 10 mounted on a gun 5 with a barrel end 6. The flashlight mount 10 holds a generally cylindrical flashlight 15 having a head 16, a tail end 17, a cylindrical housing 18 and tapered neck 19. When the flashlight 15 is mounted as shown, the longitudinal axis of the flashlight is substantially parallel to the longitudinal axis of gun 5. In addition, the head 16 of flashlight 15 faces the barrel end 6 of gun 5 to direct light in the direction in which the gun is pointed.

Figure 2:
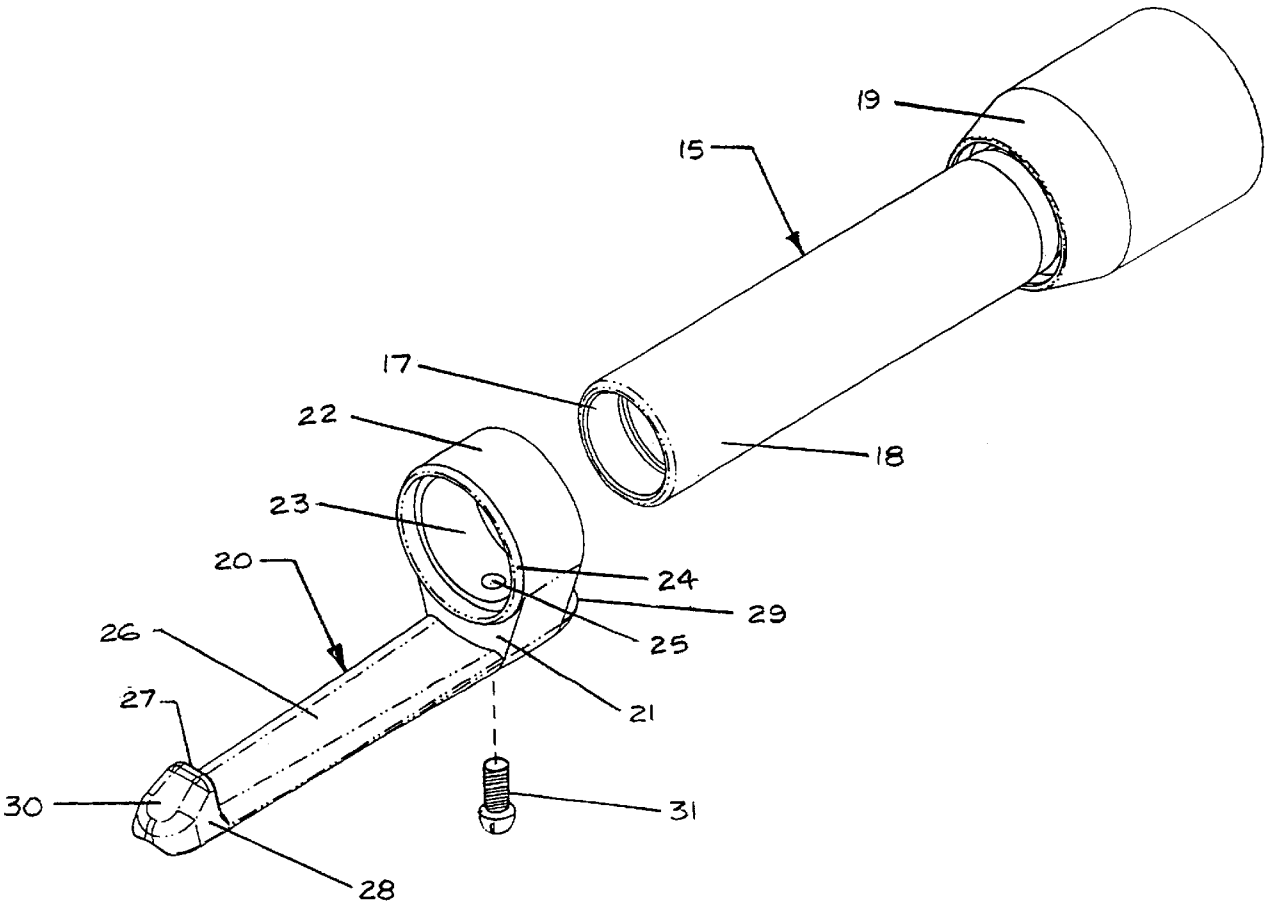
FIG. 2 is an exploded isometric view of the clip portion of the mounting device of FIG. 1 disassembled from the flashlight.

Referring now to FIGS. 1–2, the flashlight mount 10 includes a clip 20 releasably attached to a mounting body 40. The clip 20 includes a rounded nose 29, a base 21, a latch 28 and an elongated arm 26 that connects the base to the latch. Latch 28 includes a tip 27 and a tapered face 30 adjacent to the tip. The base 21 of clip 20 has a hollow cylindrical body 22 having a coaxial cylindrical bore or opening 23 axially spaced from the longitudinal axis of arm 26 and adapted to receive flashlight 15. The cylindrical body 22 has an annular beveled edge 24 in its outer periphery that faces the latch 28. A hole 25 is cut through the base 21 in a direction perpendicular to the longitudinal axis of arm 26 and is adapted to receive a set screw 31.

Figure 3:
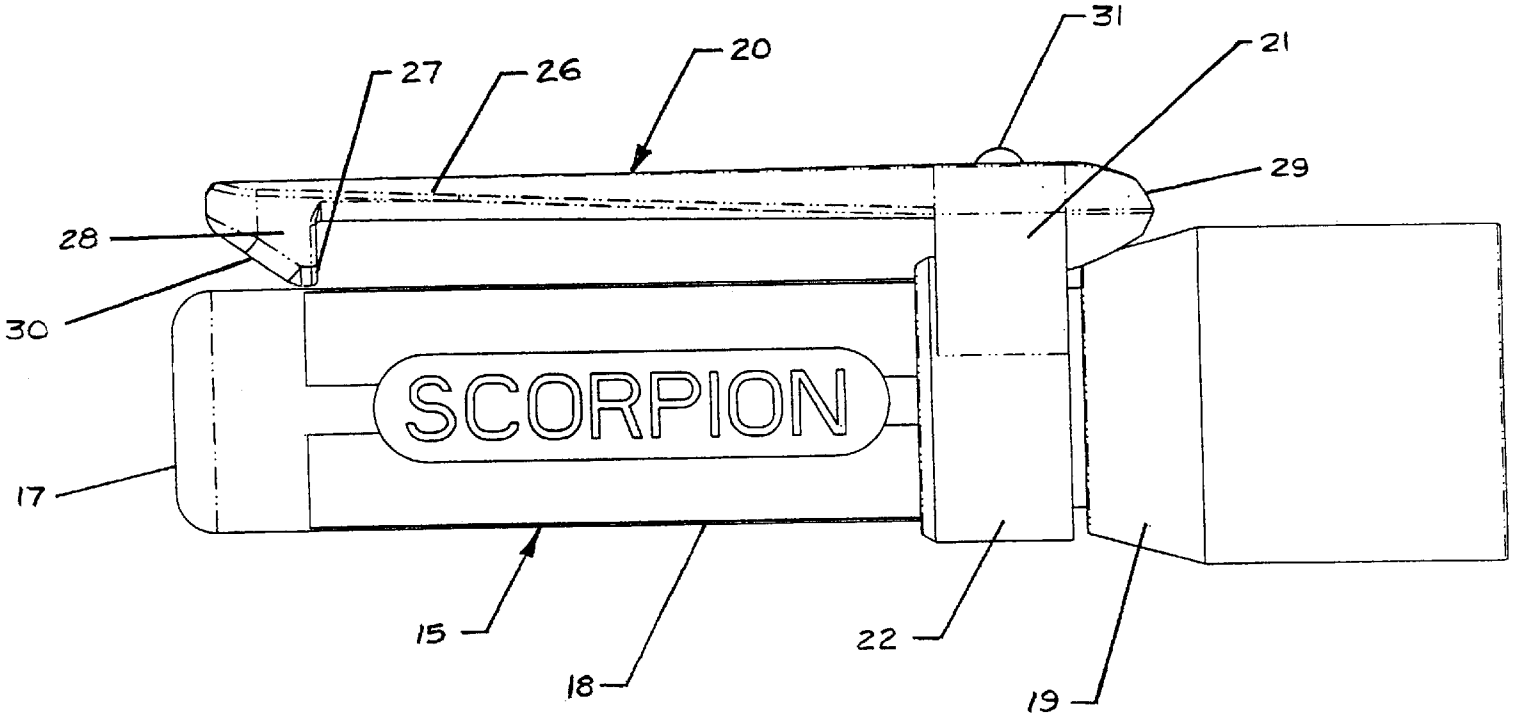
FIG. 3 is a side elevation of the clip portion of the mounting device of FIG. 1 assembled with the flashlight.

Referring now to FIGS. 2–3, the cylindrical body 22 forms a bore 23 adapted to receive the tail end 17 and housing 18 of flashlight 15. The latch 28 is configured and positioned such that the latch tip 27 is proximal to, and preferably rests on, the flashlight housing 18 when the flashlight 15 is inserted through the cylindrical body 22. The nose 29 on clip 20 is configured to bear against the tapered neck 19 of flashlight 15 when the flashlight is fully inserted into the cylindrical body 22. Preferably, nose 29 is elliptical or rounded to cooperate with the tapered neck 19 of flashlight head 16, thereby providing greater stability to the flashlight in the clip 20. Once flashlight 15 is fully inserted into clip 20, tip 27 of latch 28 is proximal to, and preferably rests on, flashlight housing 18, as shown in FIG. 3. The set screw 31 is of a sufficient length to extend through the set screw hole 25 to bear against the flashlight housing 18 and secure the flashlight within the cylindrical body 22.

Referring now to FIGS. 1–3, clip 20 is preferably formed of a resiliently flexible material, such as nylon, nylon 6, reinforced nylon or other plastic, which provides flexibility and resiliency to arm 26. As used herein, "resiliently flexible" refers to the flexibility of arm 26 that allows it to deflect outwardly and away from housing 18 and return substantially to its original position, thereby imposing an inward force on the arm that permits clipping of flashlight 15 onto an object, such as a belt, pants pocket or mounting body 40. When the clip 20 containing flashlight 15 is initially clipped onto an object, the object pushes against the tapered face 30 of latch 28, displaces the latch and arm 26, and wedges in between the arm and flashlight housing 18. The resiliency of arm 26 biases the arm and latch tip 27 inwardly to clamp down onto the object and secure the flashlight 15 to the object. When the flashlight 15 and clip 20 are detached from the object, the flexibility of arm 26 allows the latch tip 27 to release the object, and the resiliency of the arm returns it substantially to its original position.

Figure 4A:
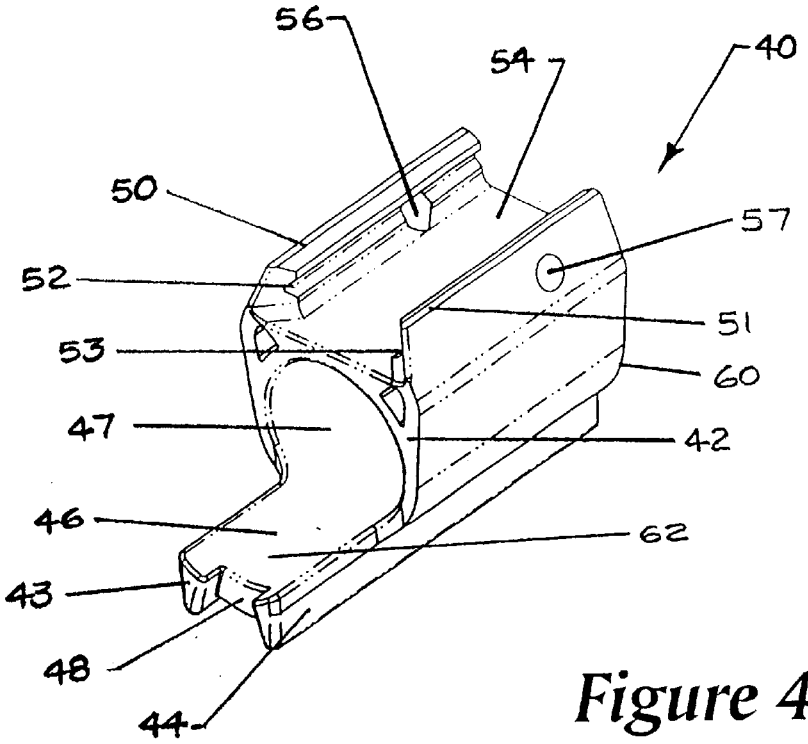
FIGS. 4A and 4B are isometric views from different perspectives of the mounting body shown in FIG. 1.
Figure 4B:
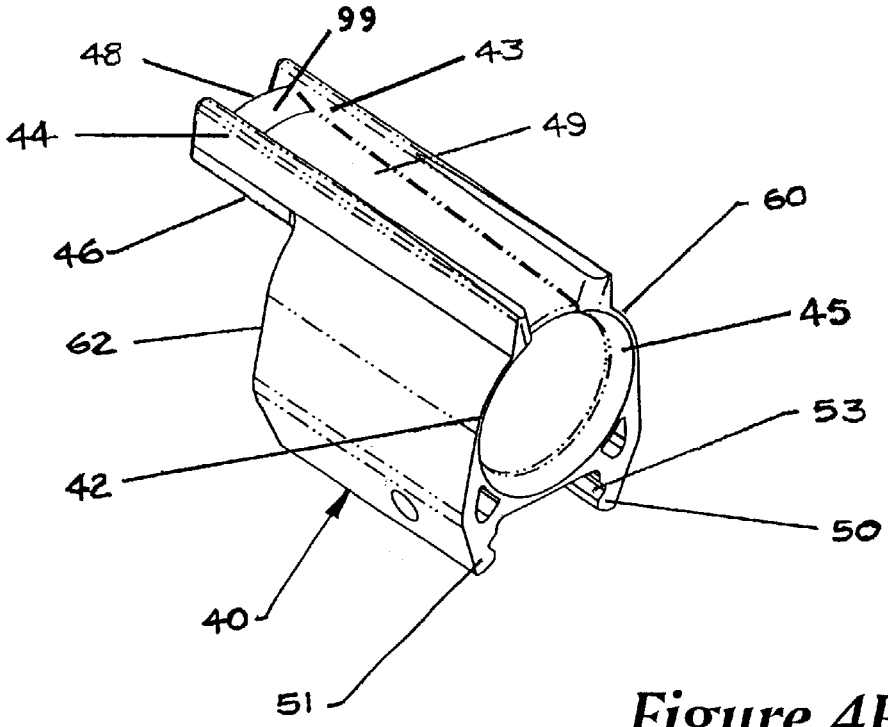

Referring now to FIGS. 4A and 4B, the mounting body 40 is shown with a forward end 60 and a rearward end 62. Like the clip 20, the mounting body 40 is preferably formed of a resiliently flexible material, such as nylon, nylon 6, reinforced nylon or other plastic, but the mounting body need not be flexible or as flexible as the clip 20. The mounting body 40 includes a sleeve 42 and a pair of pedestals 43 and 44 adapted to receive the clip arm 26 and latch 28. The sleeve 42 defines a cylindrical aperture 47 and includes an annularly beveled edge 45 on the inward periphery of the forward end 60. The beveled edge 45 is adapted to mate with the beveled edge 24 on the clip 20. The cylindrical aperture 47 has a diameter similar to the outside diameter of flashlight housing 18. The sleeve 42 also extends to define a suitable arrangement for attaching mounting body 40 to a gun or other implement.

An example of an attaching arrangement may include a pair of rails 50 and 51 separated by a channel 54. Rails 50 and 51 include longitudinal grooves 52 and 53, respectively, which face inward toward the channel 54. Rails 50 and 51 also contain a pair of transverse slots 56 and 57, respectively, that completely penetrate through the rails. Slots 56 and 57 are adapted to receive various means for securing the mounting body 40 to the gun 5. For example, slots 56 and 57 may be adapted to receive a pair of locking pins, or may be aligned with holes in gun 5 to allow the mounting body 40 to be screwed to the gun.

Mounting body 40 includes an arrangement of features for engaging clip 20. Pedestals 43 and 44 and a section of sleeve 42 between said pedestals extend to form an arc-shaped tongue 46 at the rearward end 62 of mounting body 40. Pedestals 43 and 44 further define a groove or channel 49 on the exterior of mounting body 40 for receiving clip arm 26. A notch 48 adapted to mate with latch 28 of clip 20 protrudes into the end of tongue 46 and is centered on the longitudinal axis of said tongue. Notch 48 provides an engaging face for engaging latch tip 27. The exterior base of channel 49 forms a guide ramp that extends radially outwardly from the longitudinal axis of the sleeve, beginning at the forward end 60 of the mounting body 40 and expanding radially outwardly as it reaches the rearward end 62 of the mounting body. The gradual outward expansion of ramp 99 allows the arm 26 to initially engage the ramp surface with minimal deflection of the arm. As the arm 26 and latch 28 are slid further between the pedestals 43 and 44, the contour of the ramp 99 gradually causes the arm and latch to deflect outward from the flashlight 15. Once the latch 28 is slid beyond the end of the ramp and over the notch 48, the resilient property of the arm 26 forces the latch back toward the flashlight 15 and into the notch 48. Engagement of the latch 28 and latch tip 27 in notch 48 assists in minimizing lateral and longitudinal movement between the clip 20 and mounting body 40, thereby holding light 15 in a desired position in relation to gun 5.

The use of the flashlight mount 10 will now be described. Referring back to FIG. 2, the flashlight housing 18 is held in coaxial alignment with the bore 23 of clip 20, such that the tail end 17 of flashlight 15 is adjacent to cylindrical body 22. The tail end 17 of flashlight 15 is then inserted through bore 23, followed by the flashlight housing 18. The flashlight housing 18 is slid through bore 23 until nose 29 of the clip 20 abuts the tapered neck 19 of flashlight 15, as shown in FIG. 3. The set screw 31 is then rotated clockwise in the set screw hole 25 as needed to bear against the flashlight housing 18 and secure the flashlight 15 against the inside wall of the cylindrical body 22. With the flashlight 15 inserted into the clip 20, the flashlight can be clipped to an object or article of clothing.

Figure 5:
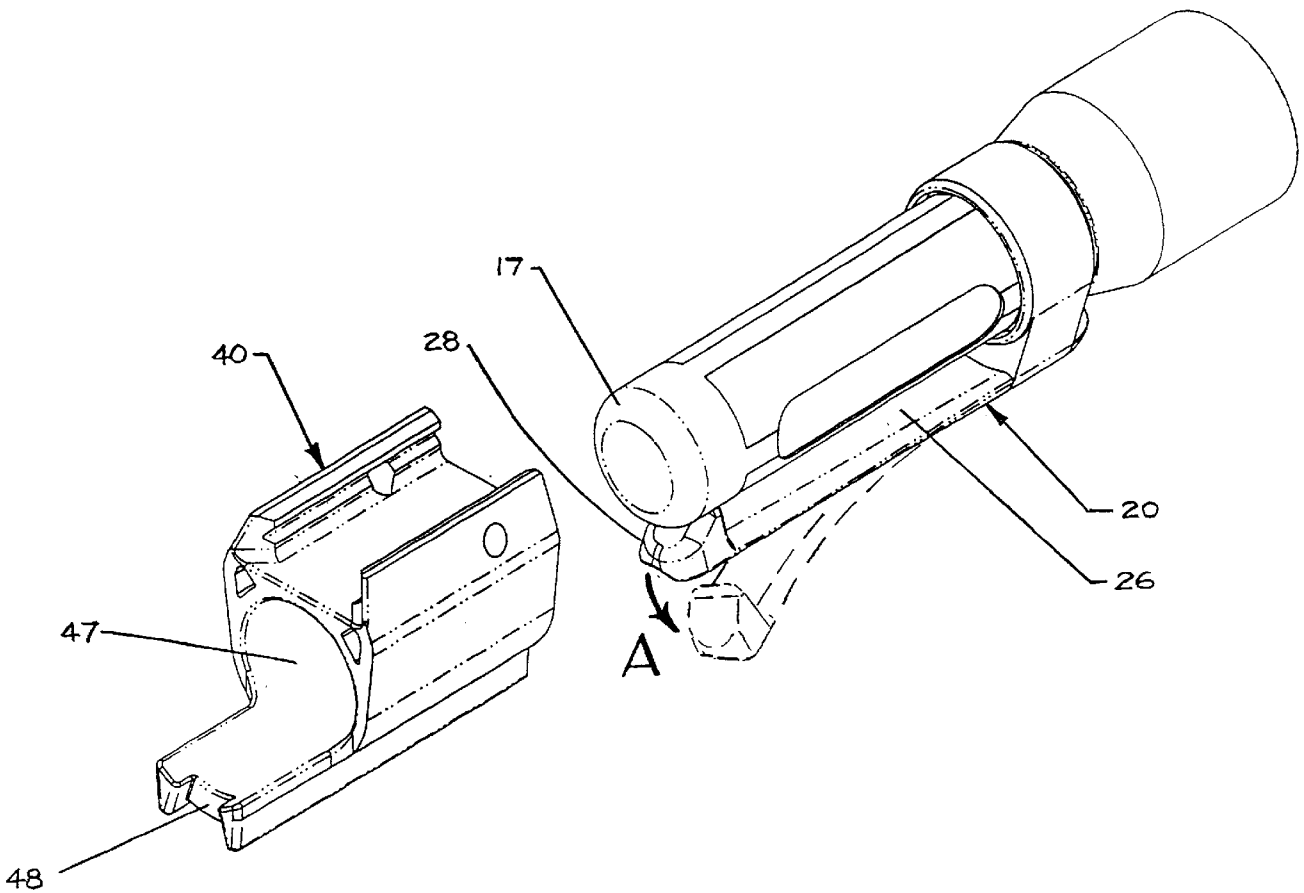
FIG. 5 is an exploded isometric view of the mounting body of FIG. 1 disassembled from the flashlight and clip of FIG. 1.
Figure 6:
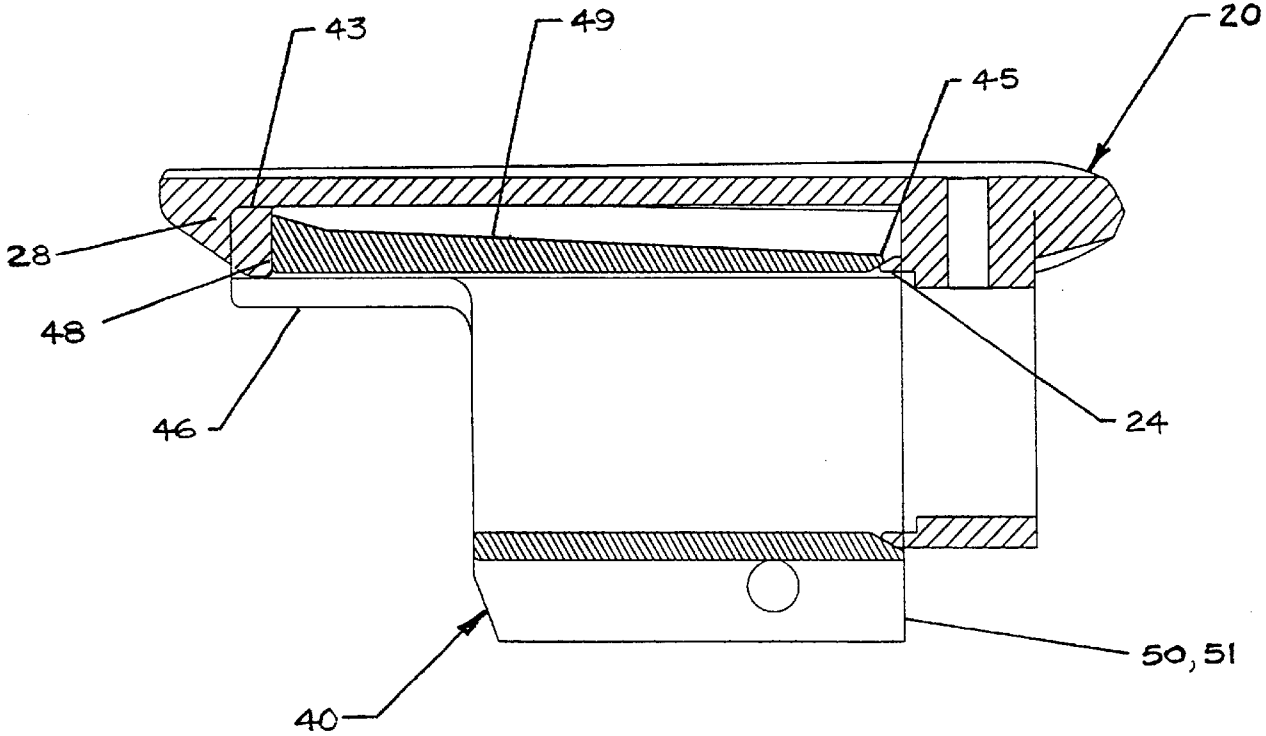
FIG. 6 is a side section elevation of the clip and mounting body of FIG. 1 fully assembled.

To mount the flashlight 15 and clip 20 to a gun 5, as shown in FIG. 1, the flashlight 15 is held in coaxial alignment with the mounting body 40, such that the tail end 17 of the flashlight is adjacent to the cylindrical aperture 47 of the mounting body, as shown in FIG. 5. The latch 28 and arm 26 of clip 20 are deflected outwardly from flashlight 15 in the direction marked A. Preferably, clip arm 26 is sufficiently flexible to permit manual deflection without the assistance of any leverage tools. The tail end 17 of flashlight 15 is then inserted into the aperture 47, followed by the flashlight housing 18. Once the housing 18 has entered the aperture 47, the latch 28 and arm 26 are released so that the latch tip 27 rests on the guide ramp 99 of mounting body 40 shown in FIG. 4B. The housing is then advanced through aperture 47, with the latch tip riding along the contour of guide ramp 99. As the latch tip 27 rides along the guide ramp 99, the latch 28 and arm 26 deflect outwardly from the flashlight 15. Once the latch tip 27 reaches the notch 48 in tongue 46, the latch tip and arm 26 deflect back inwardly toward flashlight 15. At that point, the annular beveled edge 45 of mounting body 40 mates with the beveled edge 24 of clip 20 so that the clip and mounting body are in cooperation, as shown in FIG 6. Referring back to FIGS. 1, 4A and 4B, grooves 52 and 53 are mated with corresponding surfaces on gun 5 to slidably mount the flashlight 15 to the gun. The gun 5 may be one of a variety of types of guns, including handguns, long guns or shot guns.

Thus far, the preferred embodiment has been described as a device for mounting a flashlight 15 to a gun 5. However, the present invention is adaptable to mount a flashlight to a variety of objects in addition to guns, including tools, tables and walls. Therefore, it is intended that the mounting device 10 be used for mounting lights to a variety of objects and structures.

Figure 7:
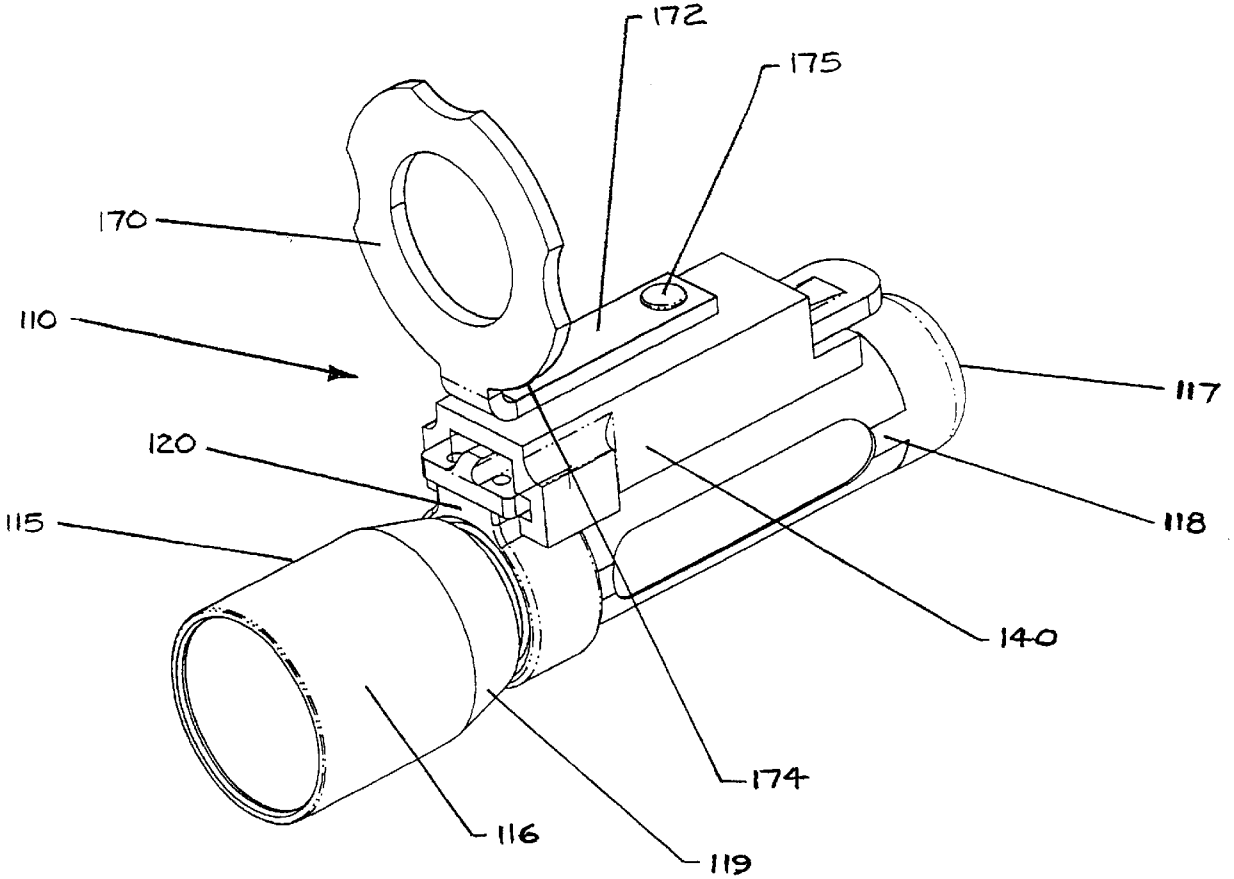
FIG. 7 is an isometric view of an alternative embodiment of the flashlight mounting device in accordance with the invention.

Referring now to FIG. 7, an alternate embodiment of the invention is illustrated and designated generally 110. The device 110 includes a clip 120 adapted to hold a flashlight 115, a mounting body 140 and a metal mounting ring 170 fastened to the mounting body. The flashlight has a head 116, a tail end 117, a housing 118 and a tapered neck 119. The clip 120 is releasably attachable to the mounting body 140. A bore 171 through the center of ring 170 is adapted so as to allow the ring to be slipped over part of a gun, such as a gun barrel.

Figure 8A:
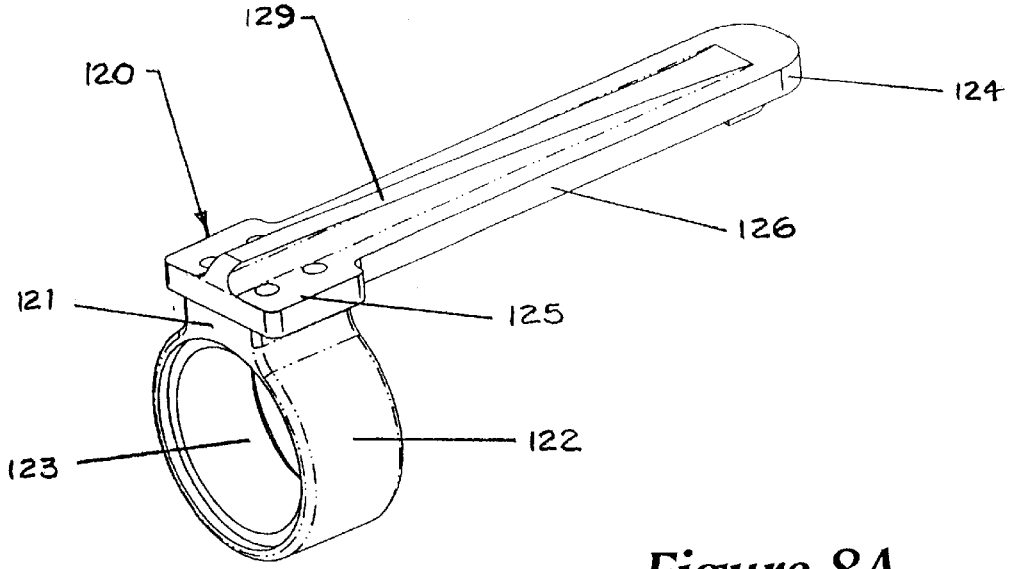
FIGS. 8A and 8B are isometric views from different perspectives of the clip portion of the mounting device of FIG. 7.
Figure 8B:
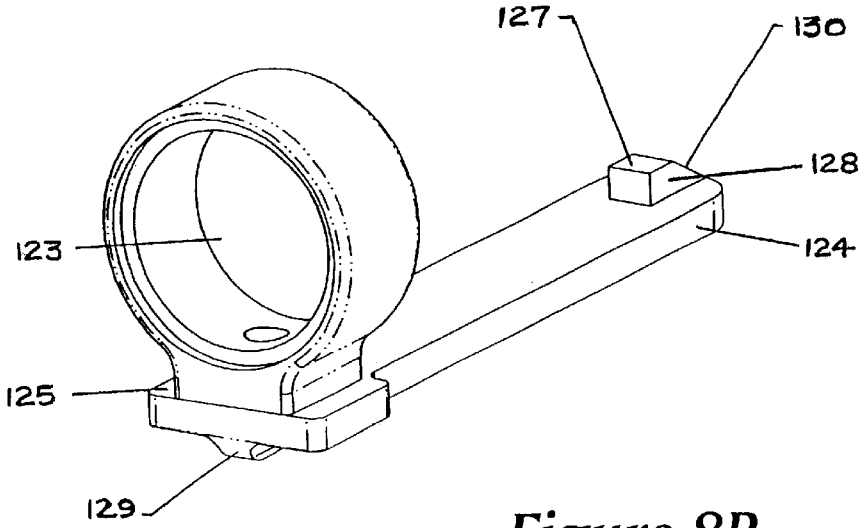

As shown in FIGS. 8A and 8B, clip 120 includes a base 121, a hollow cylindrical body 122 and an elongated arm 126 extending from the base. The arm 126 has two ends: a flanged end 125 connected to the base 121 and a distal end 124. The distal end 124 of arm 126 contains a latch 128 similar to the previous embodiment. The latch 128 includes a latch tip 127 and a tapered face 130. A ridge 129 protrudes from the arm 126 on the side opposite of the latch 128 and extends along the longitudinal axis of the arm so as to bisect the arm. The ridge 129 is flush with the arm at the distal end and protrudes increasingly outwardly as it reaches the flanged end 125 to add proportional strength and stiffness along the length of the arm.

The cylindrical body 122 forms a bore 123 adapted to receive the tail end 117 and housing 118 of flashlight 115. Bore 123 has a diameter that is similar to the outside diameter of housing 118 such that the outside surface of the housing is proximal to the inside surface of the cylindrical body 122 when the flashlight is inserted into the clip 120. Similar to the previous embodiment, when the flashlight 115 is inserted into clip 120, the latch tip 127 is proximal to, and preferably rests on, flashlight housing 118. After the housing 118 has been inserted through cylindrical body 122, the tapered neck 119 of the flashlight 115 prevents further insertion of the flashlight into the cylindrical body. The clip 120 is preferably formed of a resiliently flexible material, such as nylon, nylon 6 or reinforced nylon, providing flexibility and resiliency to arm 126.

Figure 9A:
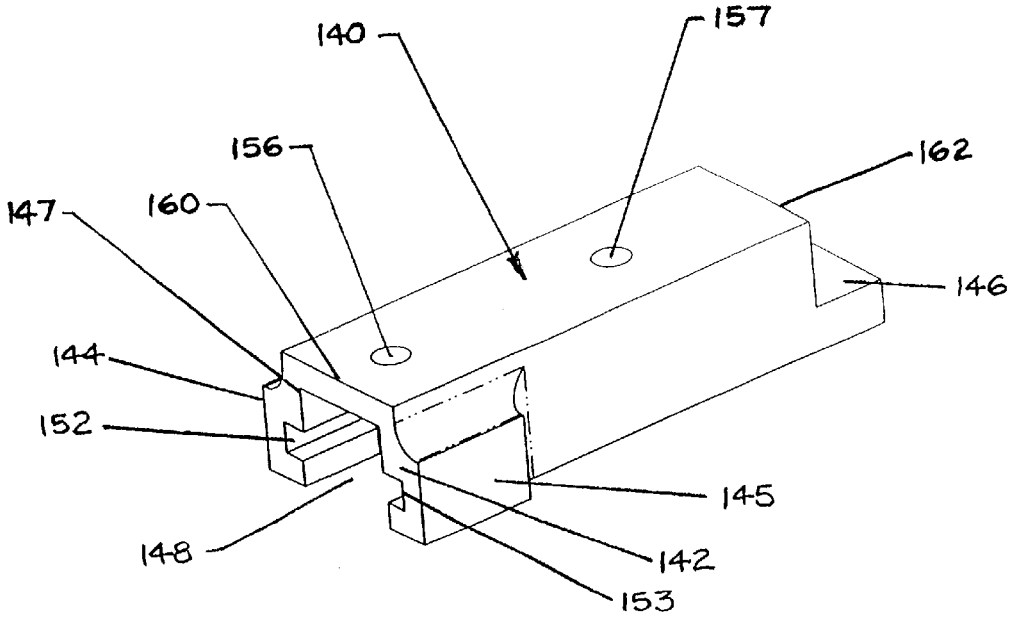
FIGS. 9A and 9B are isometric views from different perspectives of the mounting body of the mounting device of FIG. 7.
Figure 9B:
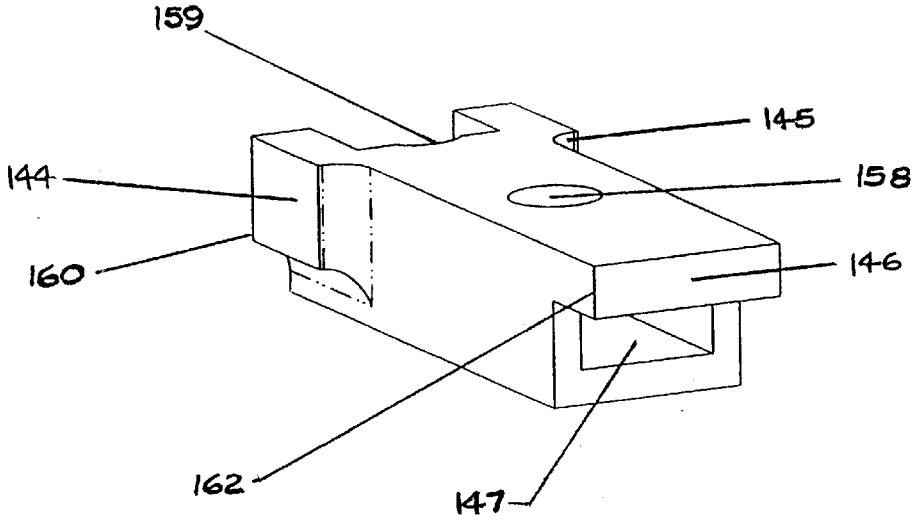

Referring now to FIGS. 9A and 9B, the mounting body 140 is shown with a forward end 160 and a rearward end 162. The mounting body 140 includes a sleeve 142 that forms a rectangular channel 147 extending longitudinally from the forward end 160 to the rearward end 162. The sleeve 142 flares outwardly at the forward end 160 to form a pair of wings 144 and 145. A pair of rectangular grooves 152 and 153 extend longitudinally along the interior of wings 144 and 145, respectively, and adjoin with rectangular channel 147 so as to form a polygonal aperture 148 at the forward end 160. The polygonal aperture 148 is shaped to receive arm 126 and flange 125 of clip 120.

The sleeve 142 contains means for attaching the mounting ring 170 to the mounting body 140. As shown in FIG. 7, the mounting ring 170 includes an elongated bar 172 that secures the ring to the mounting body 140. The bar 172 is attachable to the mounting body 140 in a number of ways, including screws, bolts, rivets or other fastening arrangements. The mounting ring 170 could also be molded with the mounting body 140. In FIG. 7, the elongated bar 172 is shown as being riveted to the mounting body 140 with a pair of rivets, 174 and 175. The mounting body 140 includes a pair of mounting slots 156 and 157, shown in FIG. 9A, to allow the mounting ring 170 to be riveted to the mounting body. Referring to FIG. 9B, an access port 158 and arc-shaped groove 159 on the underside of the mounting body 140 allow a riveting tool or other tool to reach the slots 156 and 157 from the underside of the mounting body when fasteners are to be connected. Once the mounting ring 170 is connected to the mounting body 140, the mounting ring can be slid around part of a gun, such as a gun barrel.

The mounting body 140 is also mountable directly to the stock of a gun without the use of the mounting ring 170. After slots 156 and 157 are aligned with similar holes in the stock, screws or bolts are inserted through the underside of the mounting body 140 and screwed into the stock of the gun. The access port 158 and groove 159 provide clearance for a screwdriver in the event that screws are used.

Figure 10:
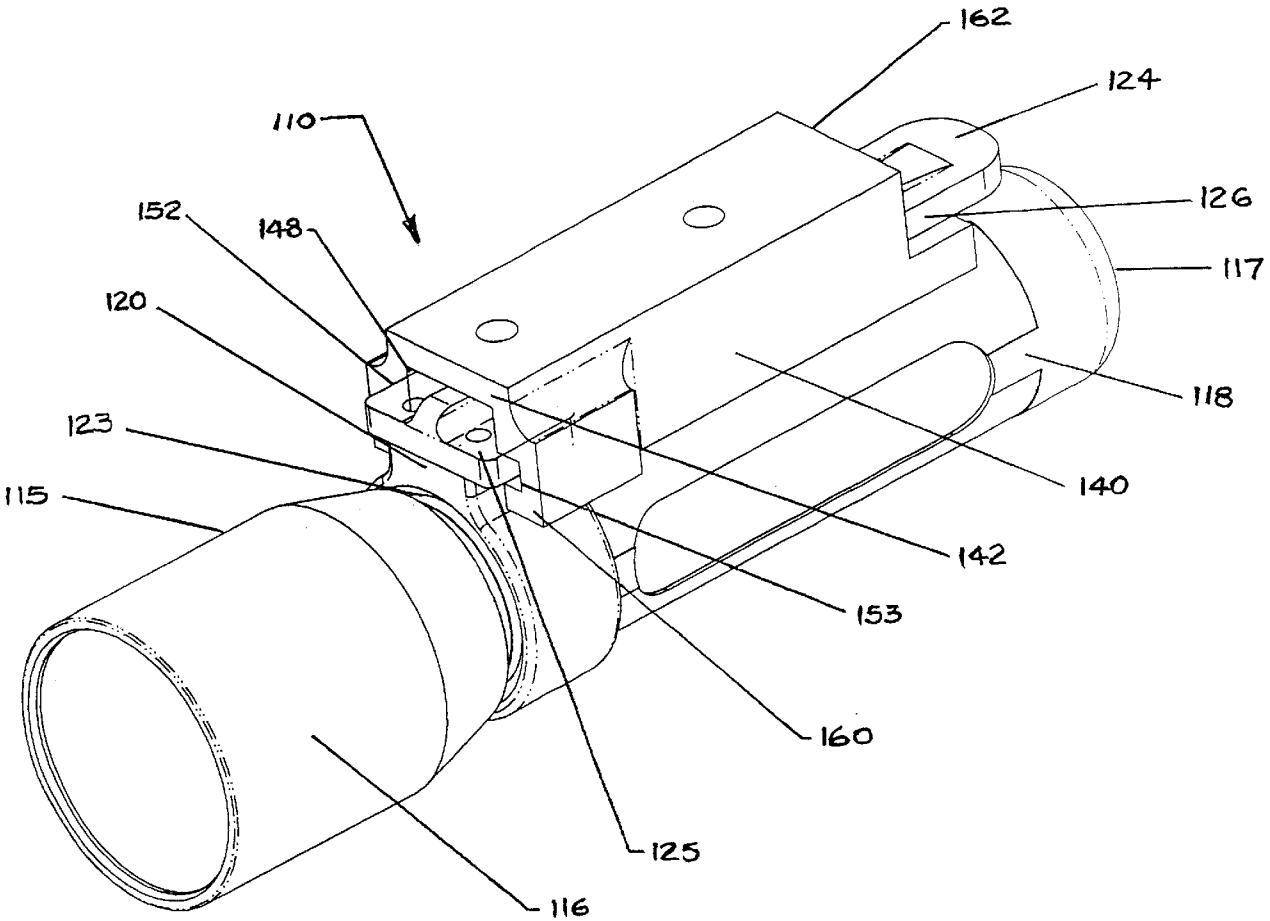
FIG. 10 is an isometric view of the assembled mounting device in FIG. 7 with the mounting ring disassembled.
Figure 11:
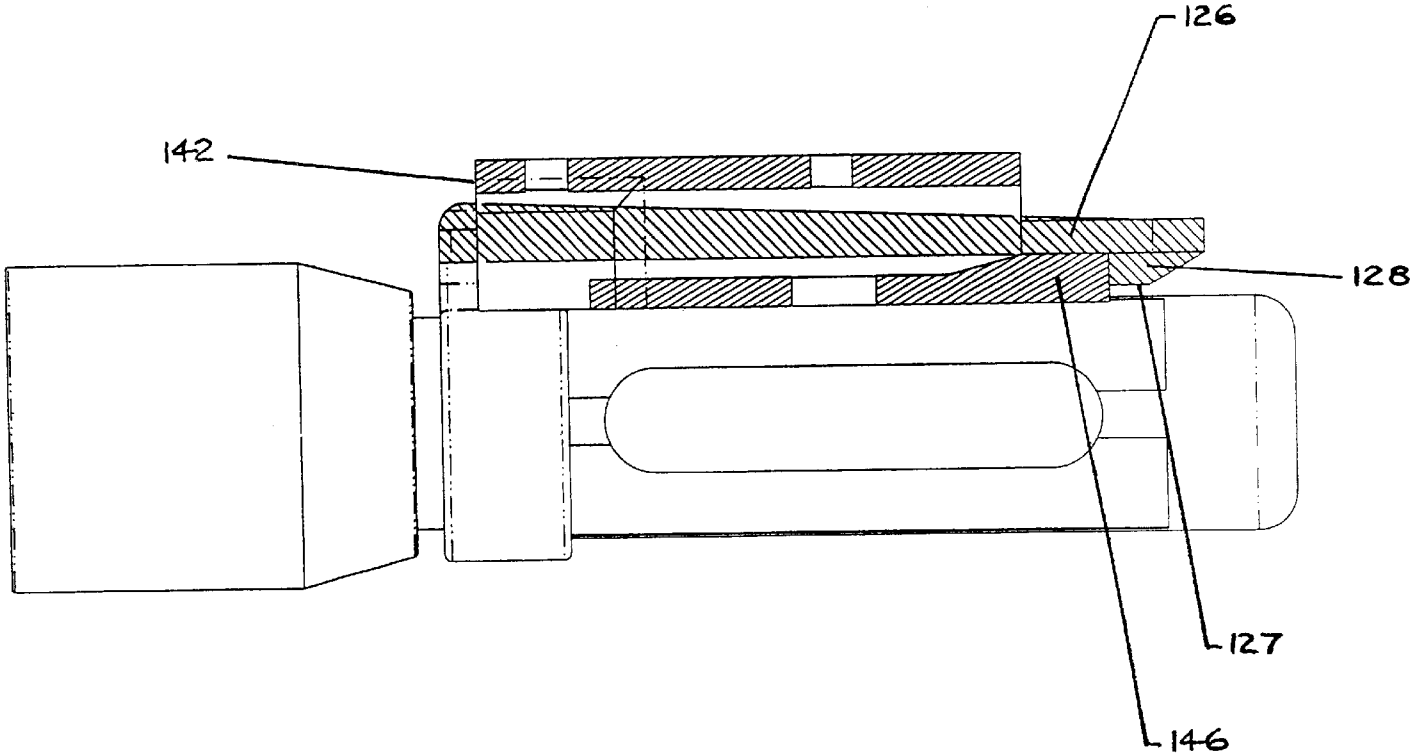
FIG. 11 is a partial side section elevation of the assembled mounting device in FIG. 7 with the mounting ring disassembled.

The operation of flashlight mount 110 is similar to that of the previous embodiment. Referring to FIG. 10, the tail end 117 and housing 118 of flashlight 115 are inserted through the bore 123 of clip 120. With the flashlight 115 inserted into clip 120, the flashlight can be clipped to an object or article of clothing. To attach the clip 120 to the mounting body 140, arm 126 is aligned with the aperture 148 at the forward end 160 of the mounting body. Once aligned, the distal end 124 of arm 126 is inserted into aperture 148 and advanced through the channel 147 so that the distal end emerges through the sleeve 142 at the rearward end 162 of mounting body 140, as shown in FIG. 10. During insertion of the arm 126, the flange 125 slides into grooves 152 and 153, thereby minimizing lateral movement of the arm within the sleeve 142. Upon completion of the insertion of arm 126 through the sleeve 142, the latch tip 127 passes over the tongue 146 so that the arm and latch 128 are flush with the tongue, as shown in FIG. 11. Tongue 146 provides an engaging surface for engaging tip 127. Contact between latch tip 127 and tongue 146 assists in minimizing longitudinal movement of the arm 126 within the sleeve 142, and assists positioning light 115 in relation to an object to which it is mounted.

Figure 12:
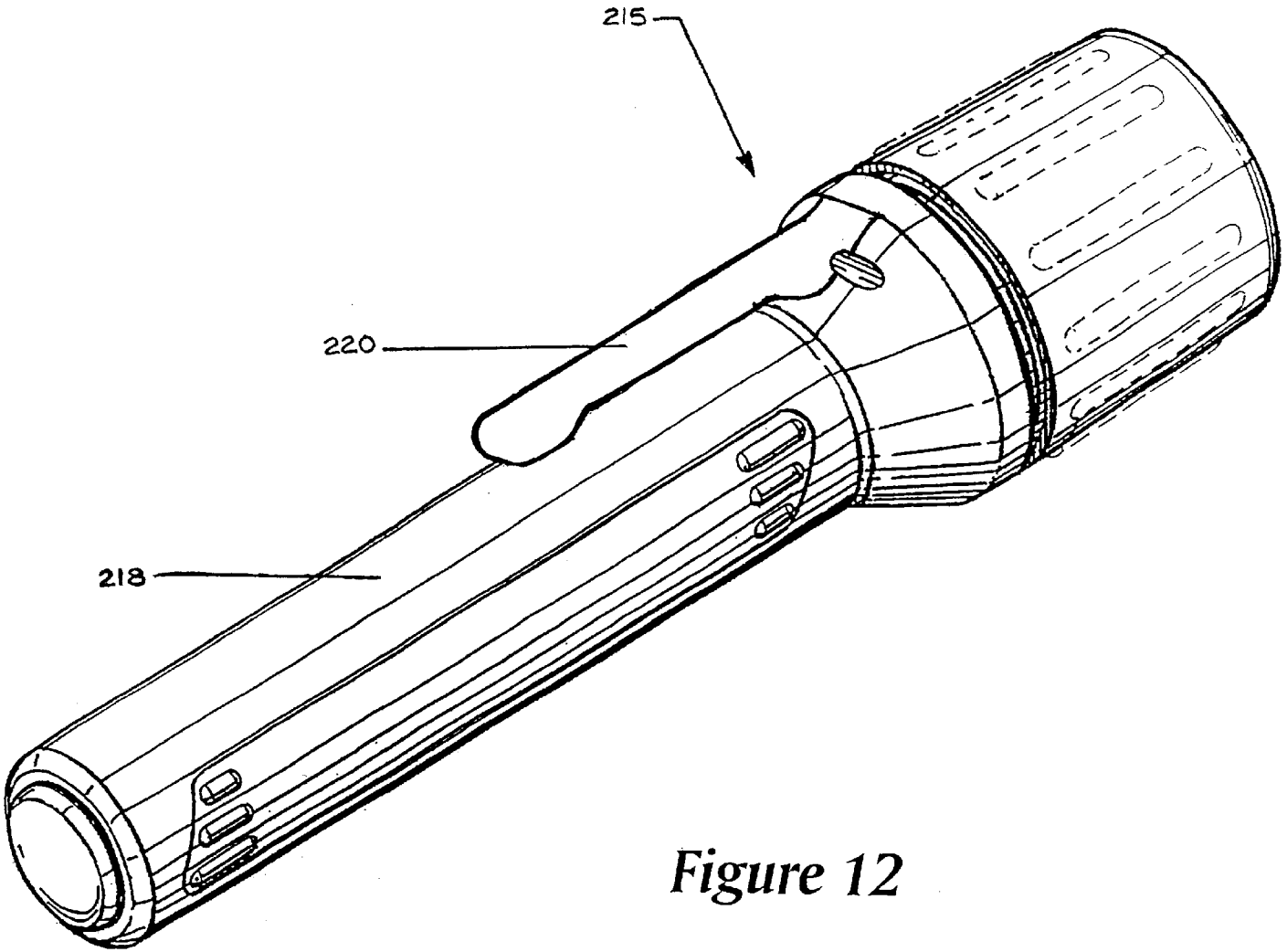
FIG. 12 is an isometric view of an alternative embodiment of a flashlight having a clip affixed to the flashlight housing.

While particular embodiments of the present invention have been herein illustrated and described, it is not intended to limit the invention to such disclosure, but changes and modifications may be made therein and thereto. For instance, flashlight 15 and clip body 22 have thus far been described as having a round or cylindrical shape. However, the flashlight housing 18 can also be polygonal, having one or more flat sides or an irregular cross-sectional shape that cooperates with an irregularly shaped bore in clip body 22. One skilled in the art will also see that the flashlight 15 and clip 20 need not be separate and distinct components. Referring now to FIG. 12, a clip 220 can be affixed to a flashlight housing 218 so that the clip is an integral part of flashlight 215. Clip 220 can be molded to flashlight 215 or attached to the flashlight using glue, bolts or any other common fastener. In such a case, the clip 220 does not require a cylindrical collar to secure the clip to the flashlight 215. The cylindrical body 22 on clip 20 has been described herein as being a closed cylinder with no partition or break in the cylinder wall. However, the cylindrical body that receives the flashlight could also be an open or "C-shaped" cylinder with a cut through the wall. This opening would allow the cylinder to flexibly expand to accommodate flashlights of varying diameters. The cylinder could include a cut in its wall and an adjustable coupling fastened over the opening. The coupling could contain one or more screws to adjust the size of the bore, or could be resiliently flexible as needed to accommodate flashlights of different sizes.

As a result, the scope of the invention should be determined in accordance with the following claims.

What is claimed is:

1. A flashlight clip and mount comprising:

a flashlight clip including:

a body having an opening adapted for receiving a flashlight; and a flexible clip arm extending from said body and having a latch tip adapted for clipping a flashlight to a first object; and a flashlight mount including:

a body having a first engaging feature adapted for engaging a second object and a channel having a guide surface for slidable engagement with the latch tip, said channel further having an end face substantially normal to the guide surface and configured for engagement with the latch tip to limit displacement of the clip arm and flashlight relative to the mount body.

2. The flashlight clip and mount of claim 1 wherein the flexible clip arm is constructed of a resiliently flexible material.

3. The flashlight clip and mount in claim 1 wherein the first object includes one of a pocket or a belt.

4. The flashlight clip and mount in claim 1 wherein the second object includes one of a weapon, a gun, a tool or an implement.

5. The flashlight clip and mount in claim 1 comprising a flashlight disposed in the opening in the clip body.

6. A flashlight clip and mount comprising:

a flashlight clip including:

a flexible clip arm extending from a flashlight and having a latch tip adapted for clipping the flashlight to a first object, wherein the clip arm is one of affixed to or integrally molded to the flashlight; and a flashlight mount including:

a body having a first engaging feature adapted for engaging a second object and a channel having a guide surface for slidable engagement with the latch tip, said channel further comprising an end face substantially normal to the guide surface and configured for engagement with the latch tip to limit displacement of the clip arm and flashlight relative to the mount body.

7. A mountable light comprising:

a flashlight;

a flashlight clip including:

a body having an opening adapted for receiving said flashlight; and a flexible clip arm extending from said body and having a latch tip adapted for clipping the flashlight to a first object; and a flashlight mount including:

a body having a first engaging feature adapted for engaging a second object and a channel having a guide surface for slidable engagement with the latch tip, said channel further having an end face substantially normal to the guide surface and configured for engagement with the latch tip to limit displacement of the clip arm and flashlight relative to the mount body.

8. The mountable light of claim 7 wherein the flexible clip arm is constructed of a resiliently flexible material.

9. The mountable light in claim 7 wherein the first object includes one of a pocket or a belt.

10. The mountable light in claim 7 wherein the second object includes one of a weapon, a gun, a tool or an implement.

11. A mountable light comprising:

a flashlight;

a flashlight clip including:

a flexible clip arm extending from the flashlight and having a latch tip adapted for clipping the flashlight to a first object, wherein the clip arm is one of affixed to or integrally molded to the flashlight; and a flashlight mount including:

a body having a first engaging feature adapted for engaging a second object and a channel having a guide surface for slidable engagement with the latch tip, said channel further comprising an end face substantially normal to the guide surface and configured for engagement with the latch tip to limit displacement of the clip arm and flashlight relative to the mount body.

12. A mount body adapted for receiving a flashlight, said mount body comprising an engaging feature for engaging a first article and having a channel for receiving a clip arm extending from a flashlight, said clip arm having a latch, wherein said channel has a guide surface in the channel for slidable engagement with the latch and an end face substantially normal to the guide surface and configured for engagement with the latch to limit displacement of the clip arm and flashlight relative to the mount body.

13. The mount body in claim 12 wherein the first article includes one of a weapon, a gun, a tool or an implement.

14. The mount body in claim 12 wherein the clip arm is one of affixed to or integrally molded to the flashlight.

15. A releasable flashlight mount comprising:

a flashlight clip adapted for attachment to a flashlight and including an elongated resiliently flexible arm having at one end thereof a latch having a latch tip for engaging an engaging feature; and a mounting body adapted for attachment to an object and having a channel with an engaging face proximate an end thereof for providing the engaging feature, wherein the channel of said mounting body is for releasably receiving the elongated resiliently flexible arm with the latch tip thereof engaging the engaging face of said mounting body.

16. A flashlight clip and mount comprising:

a flashlight clip including:

a body having a cylindrical sleeve adapted for receiving a flashlight;

a flexible clip arm extending generally parallel to and offset from the longitudinal axis of said sleeve, said clip arm having a latch extending inwardly toward the axis of said sleeve and an edge on the latch adapted for clipping a flashlight to a first object; and a securing means on the cylindrical sleeve for engaging and holding a flashlight securely within said cylindrical sleeve; and a flashlight mount including:

a base having a cylindrical bore adapted for receiving a flashlight;

a grooved passage offset from the longitudinal axis of the bore and extending along the exterior of the base, said passage being adapted for engaging a second object;

a securement means in the grooved passage for engaging the second object to securely hold the base on the second object; and a channel extending along the exterior of the base opposite the grooved passage, said channel having a notch for receiving and engaging the latch on said flexible clip arm to connect said flashlight clip to the base.

17. The flashlight clip and mount of claim 16 wherein the flexible clip arm is constructed of a resiliently flexible material.

18. The flashlight clip and mount of claim 16 wherein the first object includes one of a pocket or a belt.

19. The flashlight clip and mount of claim 16 wherein the second object includes one of a weapon, a gun, a tool or an implement.

20. The flashlight clip and mount of claim 16 comprising a flashlight disposed in the cylindrical sleeve.

21. A flashlight clip and mount comprising:

a flashlight clip including:

a body having a cylindrical sleeve adapted for receiving a flashlight;

a generally rectangular flange attached to the exterior of sleeve and offset from the axis of the sleeve; and a flexible clip arm extending from the flange and parallel to the longitudinal axis of said sleeve, said clip arm having an elongated ridge extending outwardly on one side of the arm and a latch on the opposite side of the arm extending inwardly toward the axis of said sleeve, said latch having an edge adapted for clipping a flashlight to a first object; and a flashlight mount including:

a base having a forward end and a rearward end;

a cavity extending through the base having a polygonal cross-section adapted to receive said clip arm on the clip;

a pair of opposed grooves in the cavity adapted to engage the flange as the clip arm is inserted into the cavity;

a ceiling in the cavity adapted to engage the ridge on said flexible clip arm as the clip arm is inserted into the cavity;

a tongue extending from the rearward end of the base, said tongue generally parallel to the longitudinal axis of the base and having a rear edge adapted to engage the latch on said flexible clip arm after the clip arm is inserted through the cavity; and attachment means on the base for affixing the base to a second object.

22. The flashlight clip and mount of claim 21 wherein the flexible clip arm is constructed of a resiliently flexible material.

23. The flashlight clip and mount of claim 21 wherein the first object includes one of a pocket or a belt.

24. The flashlight clip and mount of claim 21 wherein the second object includes one of a weapon, a gun, a tool or an implement.

25. A mountable flashlight comprising:

a flashlight having a flexible clip arm extending generally parallel to and offset from the longitudinal axis of said flashlight, said clip arm having a latch extending inwardly toward the axis of said flashlight and an edge on the latch adapted for clipping the flashlight to a first object; and a flashlight mount including:

a base having a cylindrical bore adapted for receiving the flashlight;

a grooved passage offset from the longitudinal axis of the bore and extending along the exterior of the base, said passage being adapted for engaging a second object;

a securement means in the grooved passage for engaging the second object to securely hold the base on the second object; and a channel extending along the exterior of the base opposite the grooved passage, said channel having a notch for receiving and engaging the latch on said flexible clip arm to connect said flashlight clip to the base.

26. The flashlight clip and mount of claim 25 wherein the flexible clip arm is constructed of a resiliently flexible material.

27. The flashlight clip and mount of claim 25 wherein the first object includes one of a pocket or a belt.

28. The flashlight clip and mount of claim 25 wherein the second object includes one of a weapon, a gun, a tool or an implement.

29. A mountable flashlight comprising:

a flashlight;

a flashlight clip affixed to the flashlight and including:

a generally rectangular flange attached to the exterior of the flashlight and offset from the axis of the flashlight; and a flexible clip arm extending from the flange and parallel to the longitudinal axis of said flashlight, said clip arm having a longitudinal ridge on one side of the arm and a latch on the opposite side of the arm extending inwardly toward the flashlight, said latch having an edge adapted for clipping the flashlight to a first object; and a flashlight mount including:

a base having a forward end and a rearward end;

a cavity extending through the base having a polygonal cross-section adapted to receive said clip arm on the clip;

a pair of opposed grooves in the cavity adapted to engage the flange as the clip arm is inserted into the cavity;

a ceiling in the cavity adapted to engage the ridge on said flexible clip arm as the clip arm is inserted into the cavity;

a tongue extending from the rearward end of the base, said tongue generally parallel to the longitudinal axis of the base and having a rear edge adapted to engage the latch on said flexible clip arm after the clip arm is inserted through the cavity; and attachment means on the base for affixing the base to a second object.

30. The flashlight clip and mount of claim 29 wherein the flexible clip arm is constructed of a resiliently flexible material.

31. The flashlight clip and mount of claim 29 wherein the first object includes one of a pocket or a belt.

32. The flashlight clip and mount of claim 29 wherein the second object includes one of a weapon, a gun, a tool or an implement.

* * * * *